United States Patent [19]

Williams et al.

[11] Patent Number: 4,722,713

[45] Date of Patent: Feb. 2, 1988

[54] BABY'S TOY AND THINGS TO AROUSE ATTENTION THEREFOR

[75] Inventors: D. Michael Williams, New York; Lois E. Kelly, Brooklyn, both of N.Y.

[73] Assignee: Johnson & Johnson Baby Products Company, New Brunswick, N.J.

[21] Appl. No.: 763,418

[22] Filed: Aug. 7, 1985

[51] Int. Cl.[4] ..... A63H 33/00

[52] U.S. Cl. ..... 446/227; 446/901; 248/102

[58] Field of Search ..... 446/227, 901; 248/102, 248/104

[56] References Cited

U.S. PATENT DOCUMENTS

| | | | |
|---|---|---|---|
| 2,402,861 | 6/1946 | Winnick | 446/227 |
| 4,096,977 | 6/1978 | Barville et al. | 248/102 X |
| 4,537,341 | 8/1985 | Kelly | 248/104 X |
| 4,594,072 | 6/1986 | Cowell | 446/227 |

FOREIGN PATENT DOCUMENTS

| | | | |
|---|---|---|---|
| 578642 | 7/1946 | United Kingdom | 446/227 |

OTHER PUBLICATIONS

Kenner-Adv. from "Playthings", Aug. 1961, p. 107.
Creative Playthings Catalog, Nov., 1969, p. 5.

*Primary Examiner*—Mickey Yu
*Attorney, Agent, or Firm*—Lawrence D. Schuler

[57] ABSTRACT

A baby's toy having a flexible arched support, fasteners at each end of the arched support for attaching it to a crib, things to arouse attention, and belt-like members for connecting the things to arouse attention to the arched support. The arched support has an elongated body element formed from a foamed plastic material which is flexible and substantially noncompressible under load. The elongated foamed plastic material is covered, preferably with cloth. In a preferred embodiment, the arched support has two generally elongated body elements made of the substantially noncompressible foamed plastic material.

15 Claims, 21 Drawing Figures

BABY'S TOY AND THINGS TO AROUSE ATTENTION THEREFOR

BACKGROUND OF THE INVENTION

In general, as baby's toys there are known various types such as a sound-producing toy or a manual play toy. These toys are so devised as to promote the baby's intellectual growth and growth of the baby's physical faculties. Nevertheless, these conventional toys are not always completely satisfactory in this field. A child and his parent or parents are always seeking for something new. Of course, there are some cases where the child soon loses his interest in the toy or breaks it or where the toy is too sophisticated for the child, especially a young child.

In the process of the baby's growth, his intellectual and physical abilities develop through various stages. For instance, the development of the baby's intellectual and physical abilities is promoted by looking at the toy or listening to the sound of the toy or touching the toy. That is, the baby gains various experiences through use of the toys. And from these experiences the baby discovers new facts, and by repeated use acquires new knowledge or skills. This enables the baby to cultivate an important sense of self-satisfaction. At the same time, the toy develops the baby's abilities to play by himself or to stimulate himself. Thus, the toy provides the baby with many opportunities to learn while playing. And by attracting the baby's attention, the toy can promote the development of his abilities in a synergistically effective way. Accordingly, in order to promote this development effectively, it is useful for the toy to comprise stimulating means to appeal to the baby's instinctive curriosity and encourage the baby's exploration of many unknown worlds. It is preferred that a toy retain the baby's interest as much as possible by appealing to his visual and hearing senses, etc.

An object of this invention is to provide a baby's toy which can effectively develop his intellectual growth, namely, prceptive ability and cognitive ability, and his physical growth, namely, rough motor nerve and delicate motor ability, by attracting his interest strongly and retaining his interest in the toy.

A further object of the invention is to provide a baby's toy having an arched support made of a flexible, substantially non-compressible material and which can therefore be attached to cribs having various heights, widths, etc.

Another object of the invention is to provide a baby's toy which is aimed at being used at various stages of growth and ages due to the fact that the height, number and kind of things to arouse attention used with the toy can be changed.

A further object of the invention is the provision of such things to arouse attention for a baby's toy which can be suitably attached to any crib and which can be removed and used by themselves to encourage the baby's intellectual interest.

Another object of the invention is to provide a baby's toy made of a soft material having a high degree of safety.

DESCRIPTION OF THE PREFERRED EMBODIMENT

Figure 1:
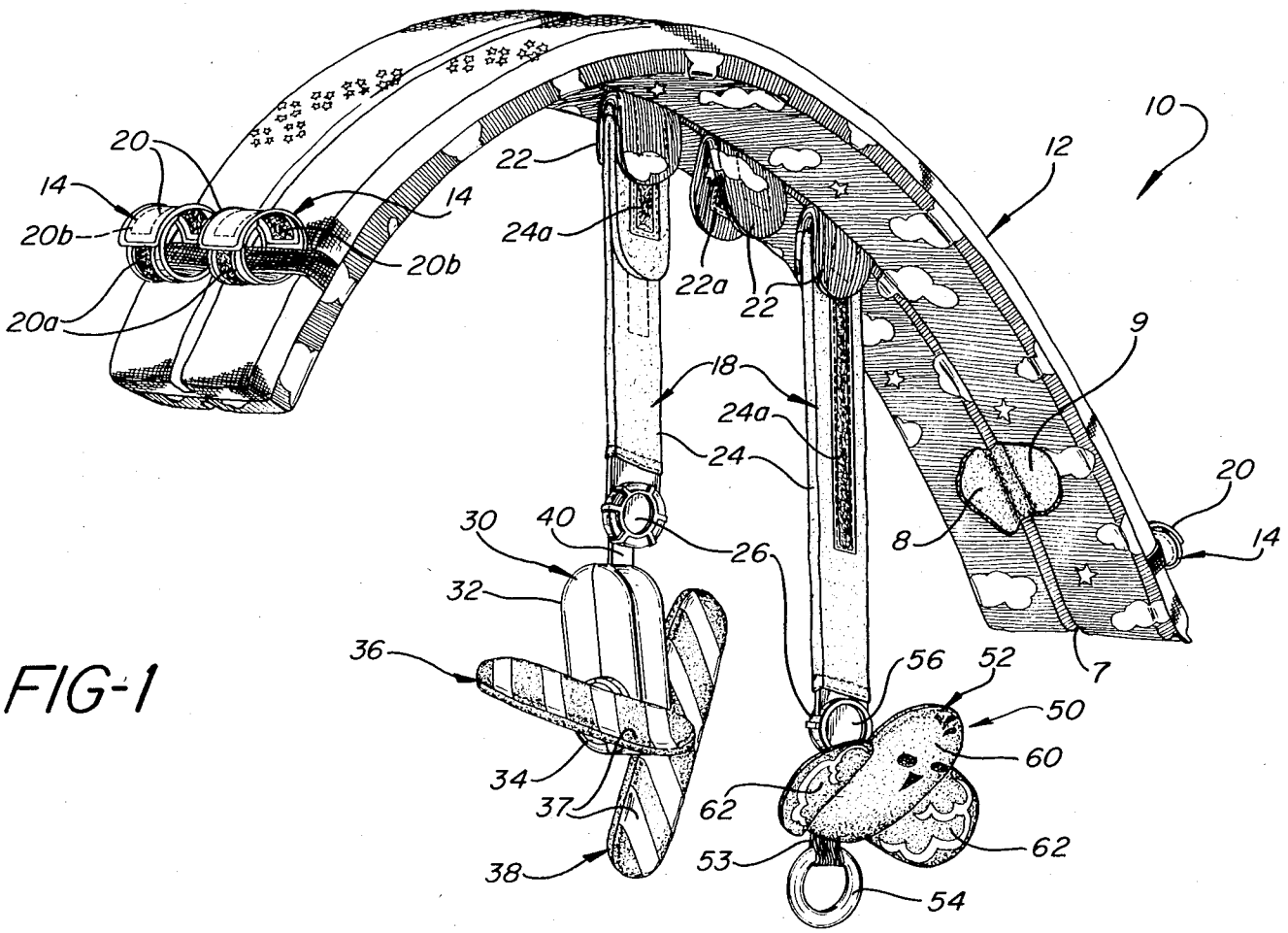
FIG. 1 is a perspective view of the toy according to one example of the present invention.

Referring to FIGS. 1 to 8, we will explain an appropriate working example of the toy of the present invention, which is used by attaching it to a crib.

In these Figures, 10 denotes a baby's toy; 12, an arched support; 14, fasteners for securing the toy to a crib; 18, connecting means for connecting things to arouse attention to the arched support; 20, first belt-like members; 22, second belt-like members; 24, third belt-like members; and 30, 50 things to arouse attention.

The baby's toy 10 according to the invention comprises a flexible, arched support 12, fasteners 14 disposed near both ends of the arched support to connect the arched support to a crib (not shown), things 30, 50 to arouse attention and means 18 for connecting the arched support 12 to the things 30, 50 to arouse attention.

Figure 2:
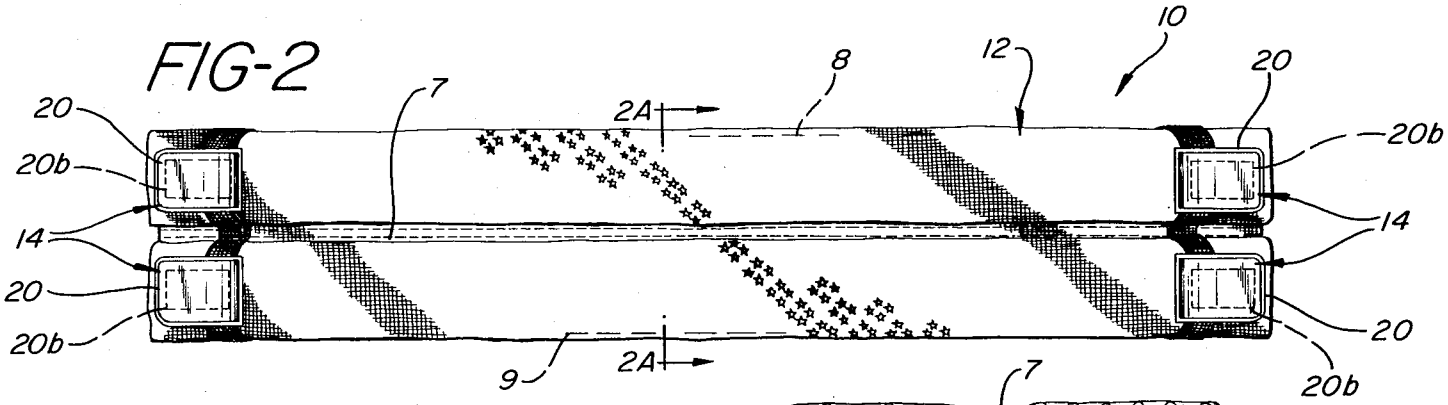
FIG. 2 is a plan view of the toy in FIG. 1.
Figure 2A:
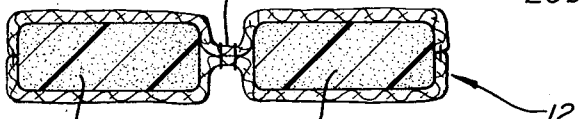
Figure 3:
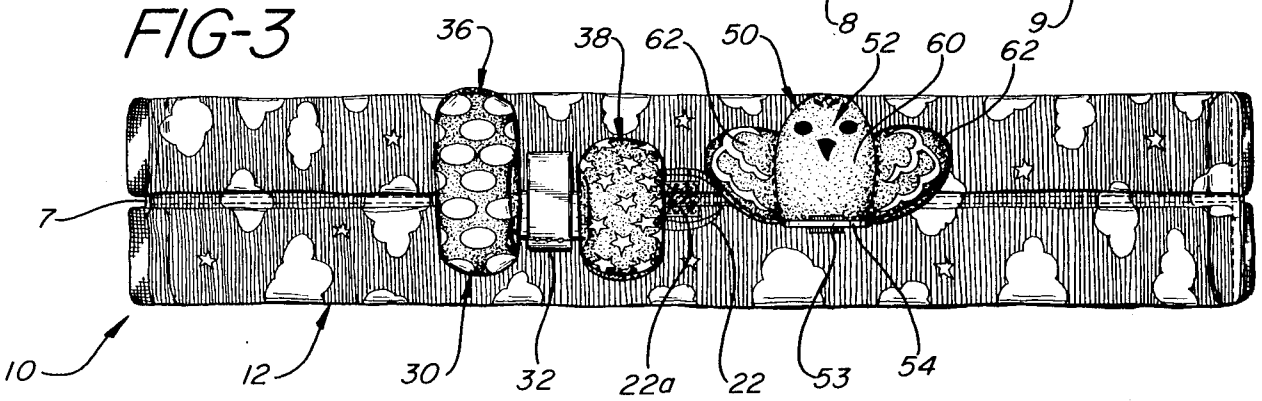
FIG. 3 is a bottom view of the toy in FIG. 1.
Figure 4:
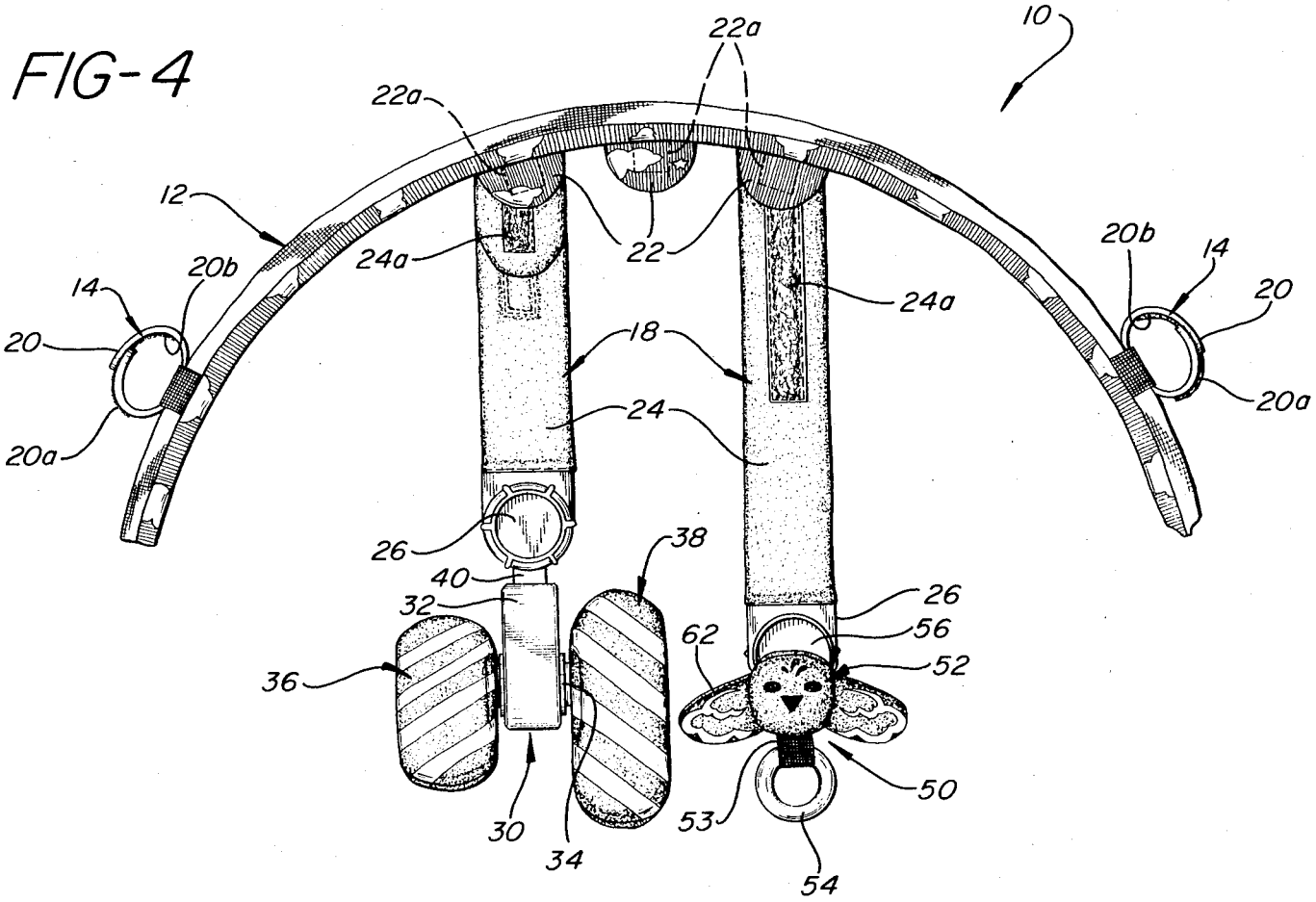
FIG. 4 is a front view of the toy in FIG. 1.
Figure 5:
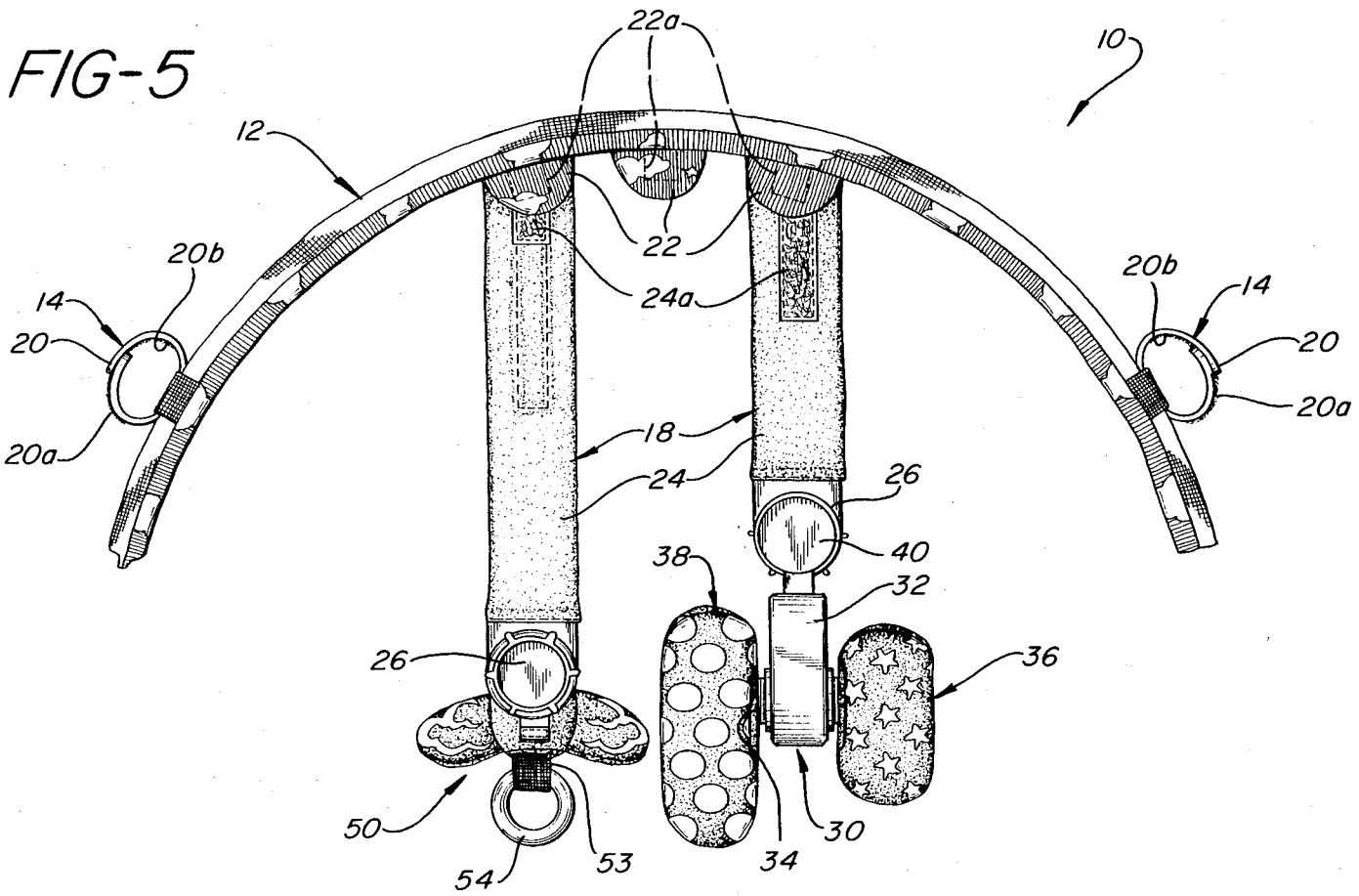
FIG. 5 is a rear elevation of the toy in FIG. 1.
Figure 6:
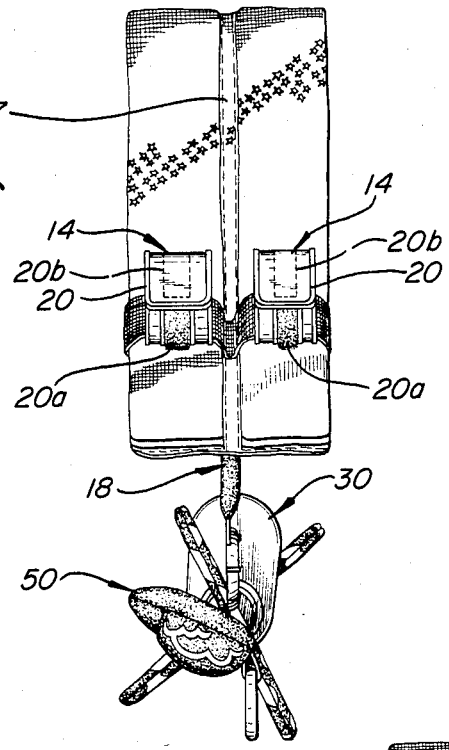
FIG. 6 is a right side view of the toy in FIG. 1.
Figure 7:
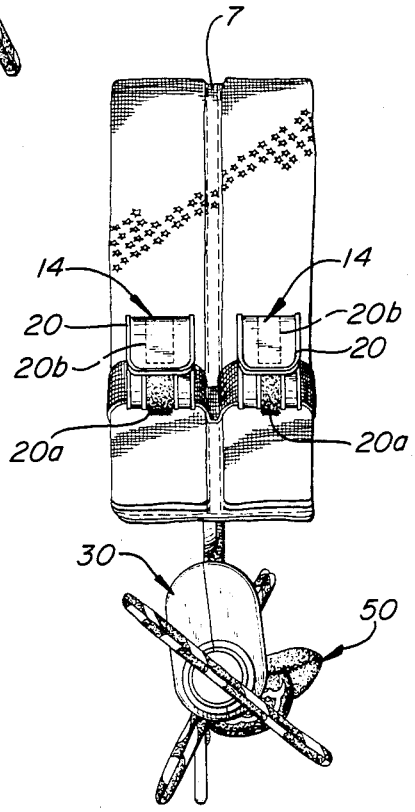
FIG. 7 is a left side view of the toy in FIG. 1.

The arched support 12 comprises two parallel, generally elongated body elements 8, 9 and coverings enclosing these elongated body elements. The arched support has a generally rectangular cross-section which is relatively thin and relatively wide. The elongated body elements comprise cellular solid foamed plastic panels made, e.g. from polyvinyl chloride, polyethylene, polystyrene, polyurethane, cellulose acetate, etc. Such foamed materials are substantially non-compressible under load, e.g. they cannot be compressed between one's thumb and forefinger nor can they be compressed when an object weighing several pounds or more is placed on them. A cellular solid polyethylene foam made by Dow Chemical Company under the designation ETHA FOAM MS-45 and having a specific gravity in the range of about 0.03 to 0.15 has been found to be suitable for elongated body elements 8, 9. As a non-limiting example, each of the body elements is about 38 inches (96.52 cm.) long, about 2⅜ inches (6.03 cm.) wide, and about 1 inch (2.54 cm.) in thickness. The coverings cover the two elongated body elements, and are connected to each other between said two elongated body elements by sewing in such fashion s to leave a longitudinal groove or spacing 7 between the body elements of the arched support 12, as seen in FIGS. 1 and 2. the covering may be formed, for example, from a cloth, a vinyl sheet, etc., cloth being preferred for this purpose. Since the elongated body elements are formed from flexible material, the arched support 12 is flexible. When the elongated body elements 8 and 9 are made from a foamed plastics materials as aforesaid, toy 10 of the invention is desirably characterized by a certain degree of resiliency. When a child grasps the things to arouse attention (30, 50) and tugs on them, the resiliency of the cellular, solid foamed plastics material allows the arched support 12 to be temporarily "deformed" downwardly from the position illustrated in FIG. 1. When the child releases its grasp, arched support 12 will return to its original configuration with no permanent deformation having been imparted thereto. An arched support made of foamed plastics material has further advantages in that it is safer than rod-like supports made of metal or solid plastic. In addition, the use of foamed plastics is desirable in view of the fact that the arched body 12 can be attached to cribs having various widths. Finally, since the arched support 12 has the resiliency and flexibility referred to, it cannot be used by the child as an aid to standing up in the crib.

The fasteners 14 for securing the toy to a crib comprise first belt-like members 20. Two such fasteners are attached near both ends on the outside of the arched support 12. The belt-like members 20 are fixed to the arched support 12 at their central portion and have Velcro fasteners at both free ends. As known, the Velcro fasteners comprise a first piece composed of a multiplicity of hook-like elements and a second piece composed of a multiplicity of loop-like elements. The belt-like members 20 have the first piece **20*a* of the Velcro fastener on one side thereof and the second mating piece 20*b* on the other side thereof. Where the present toy 10 is attached to a crib, the arched support 12 is positioned inside the sides of the crib and the ends of belt-like members 20 are wrapped around the rod-like crib rail on either side of the crib and secured to each other to assume the loop-like configuration shown in, e.g., FIGS. 1, 4 and 8. This enables the arched support 12** to be attached to the crib.

Belt-like members 20 may alternatively be located on the inside surface of the arched support whereby it is still possible to connect the arched support 12 to the rod-like crib rail on the sides of the crib. Such arrangement is less preferable because there is a risk that a baby placed on his back in the crib may touch the belt-like member 20 comprising fastener 14 in an effort to remove it.

The things 30, 50 to arouse attention are connected to the arched support 12 by connecting means 18. It is preferred that things 30, 50 have different shapes and are respectively provided with sound-producing means that generate sound by their vibrations, the tones of sounds due to said sound-producing means being different from each other. Two typical examples of the things 30, 50 to arouse attention will be explained later by reference to FIGS. 9 to 21.

The connecting means 18 comprise second relatively short belt-like members 22, each having one piece **22*a* (seen in FIG. 8) of a Velcro fastener, fixed to the arched support 12 and third relatively long belt-like members 24, each having the other mating piece 24*a* of a Velcro fastener, to which things 30, 50** to arouse attention are attached.

Figure 8:
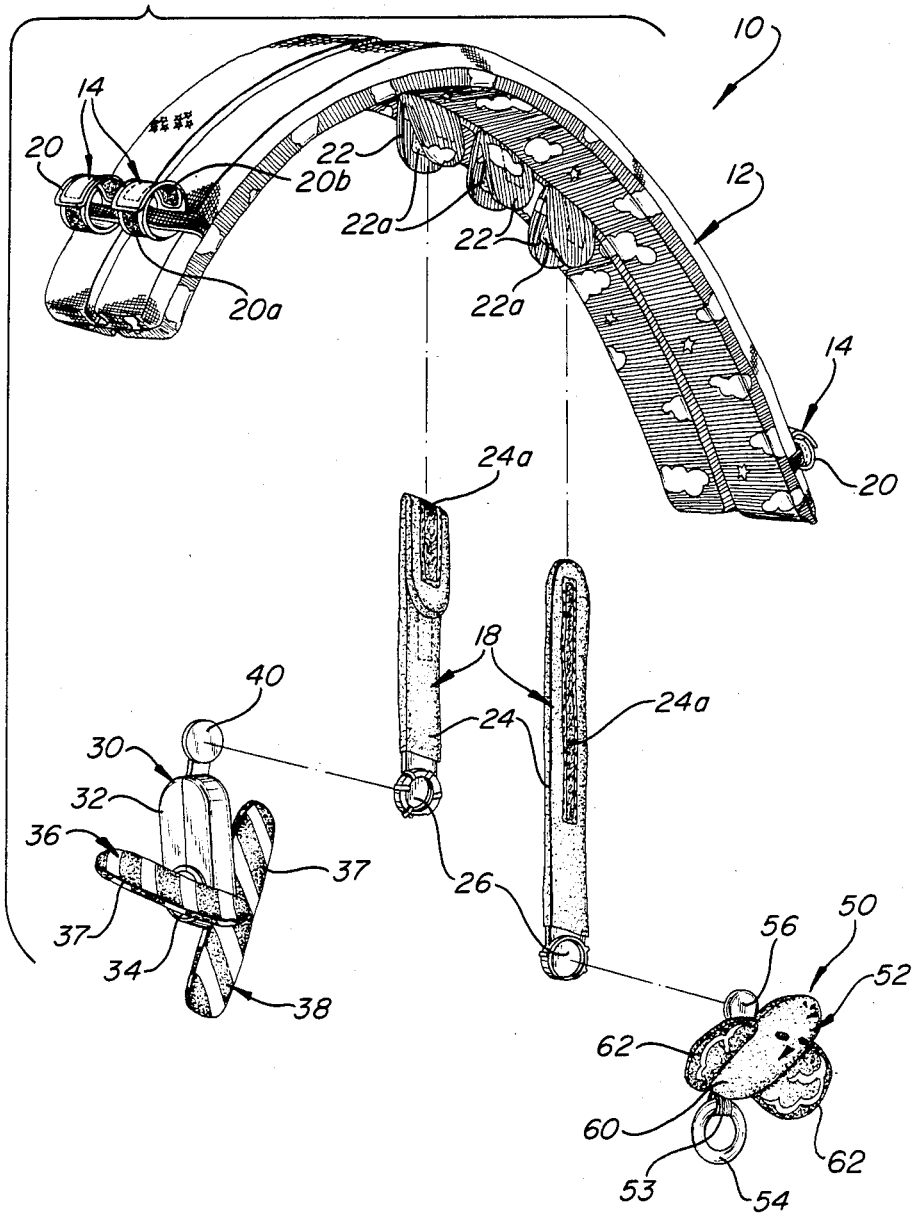
FIG. 8 is an exploded view of the toy in FIG. 1.
Figure 9:
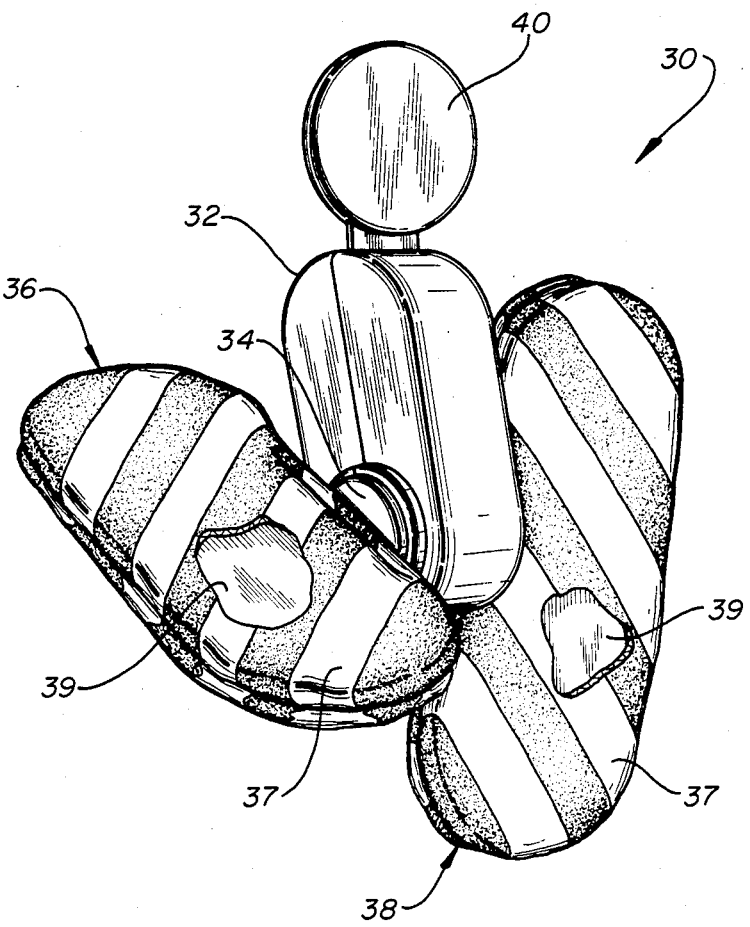
FIG. 9 is a perspective view of the thing to arouse attention used in the toy of FIG. 1.
Figure 10:
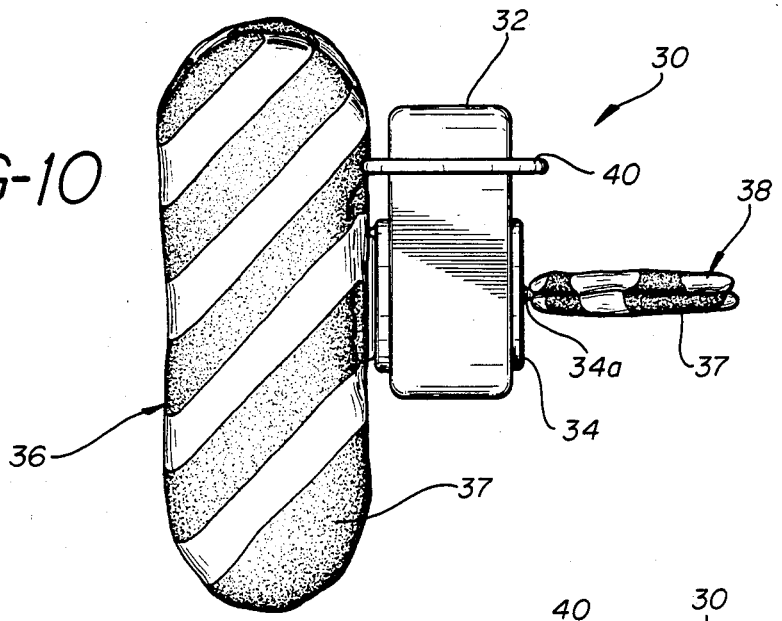
FIG. 10 is a plan view of a first thing to arouse attention shown iFIG. 9.
Figure 11:
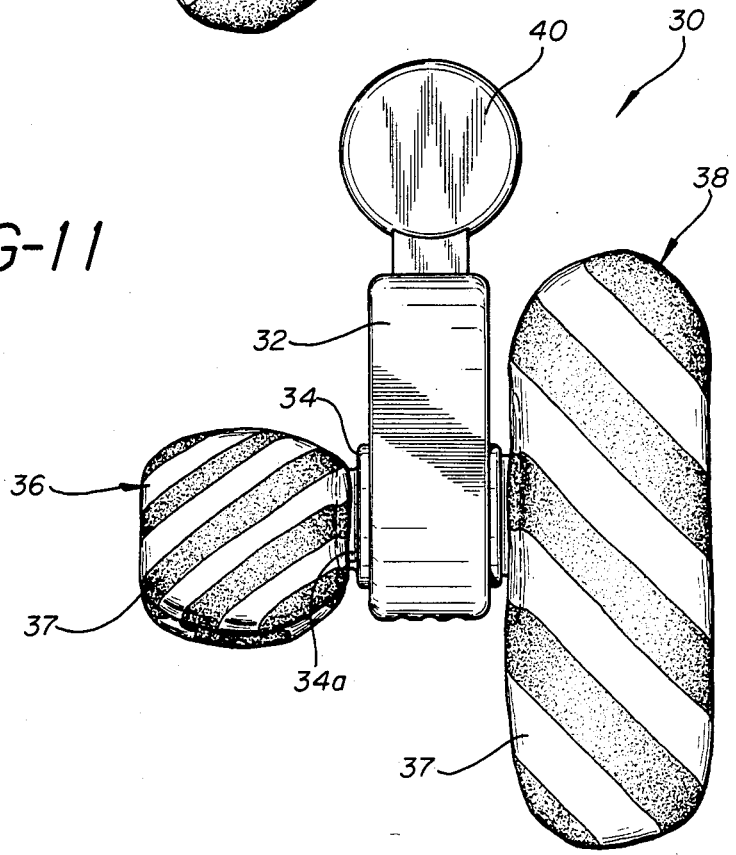
FIG. 11 is a front view of the thing to arouse attention shown in FIG. 9.
Figure 12:
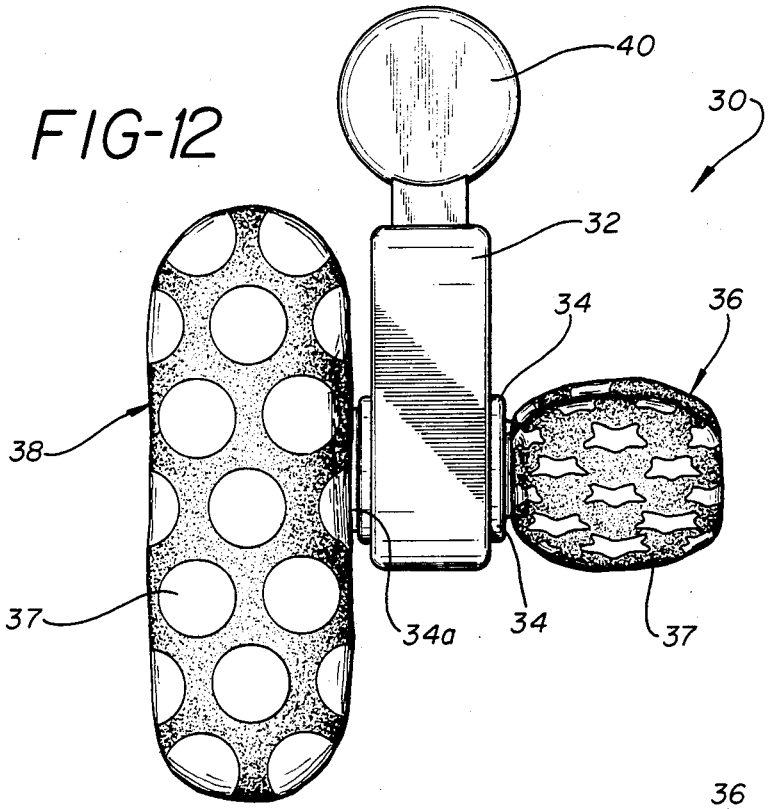
FIG. 12 is a rear elevation of the thing to arouse attention shown in FIG. 9.
Figure 13:
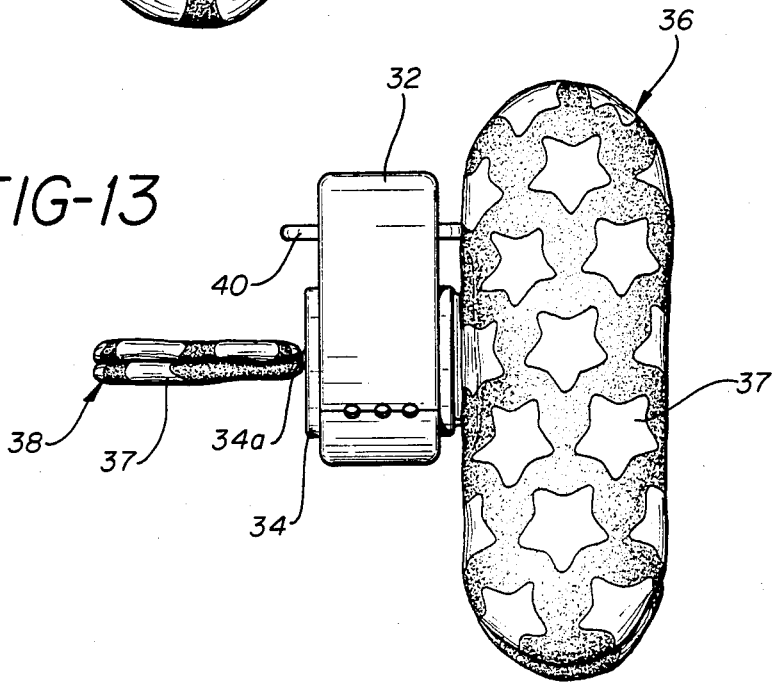
FIG. 13 is a bottom view of the thing to arouse attention shown in FIG. 9.
Figure 14:
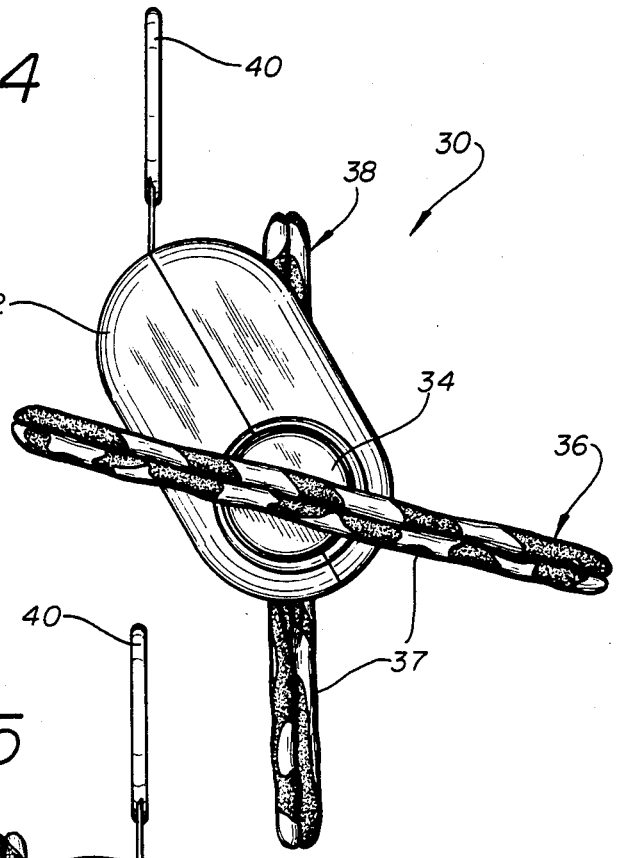
FIG. 14 is a left side view of the thing to arouse attention shown in FIG. 9.
Figure 15:
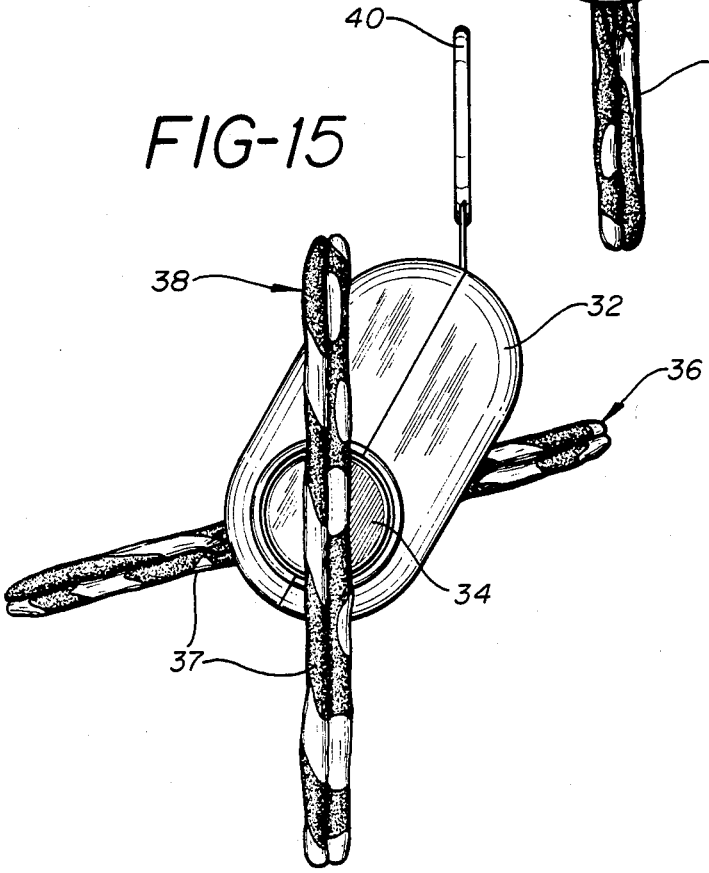
FIG. 15 is a right side view of the thing to arouse attention shown in FIG. 9.
Figure 16:
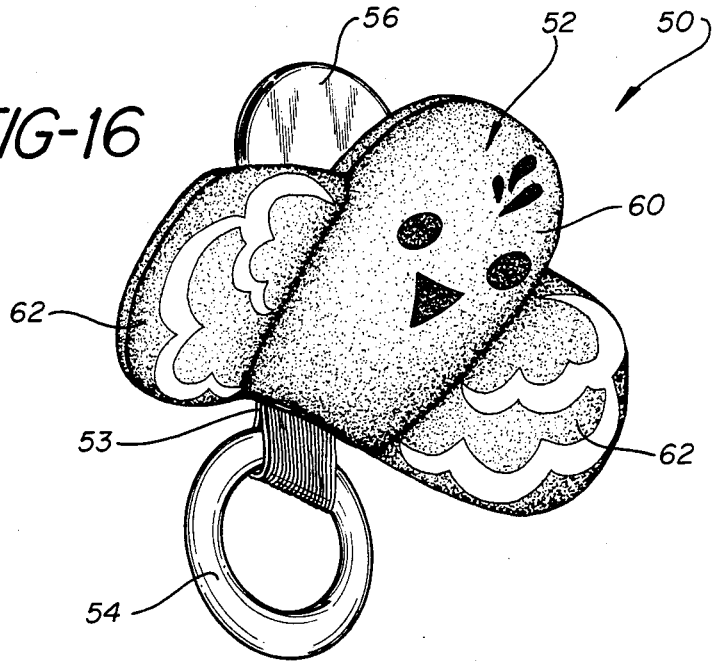
FIG. 16 is a perspective view of a second thing to arouse attention shown in FIG. 1.
Figure 17:
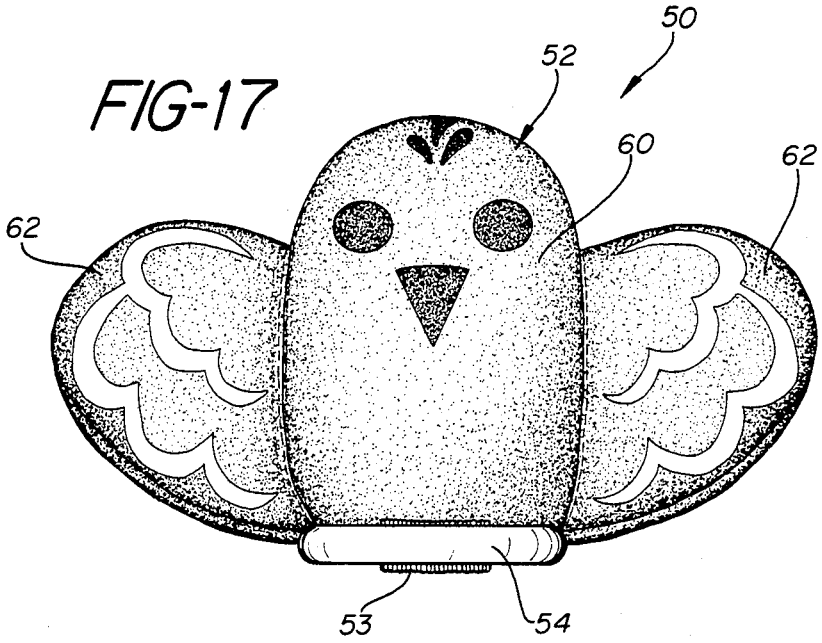
FIG. 17 is a bottom view of the thing to arouse attention shown in FIG. 16.
Figure 18:
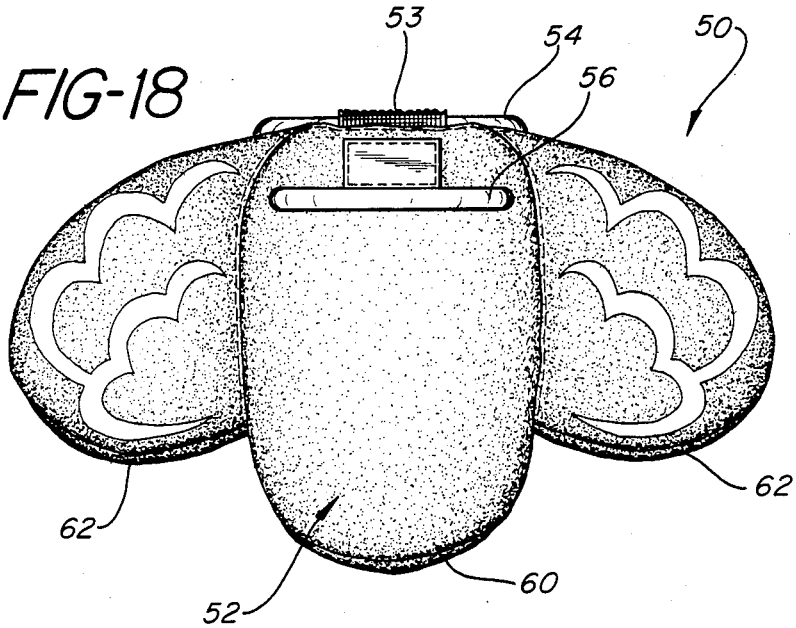
FIG. 18 is a plan view of the thing to arouse attention shown in FIG. 16.
Figure 19:
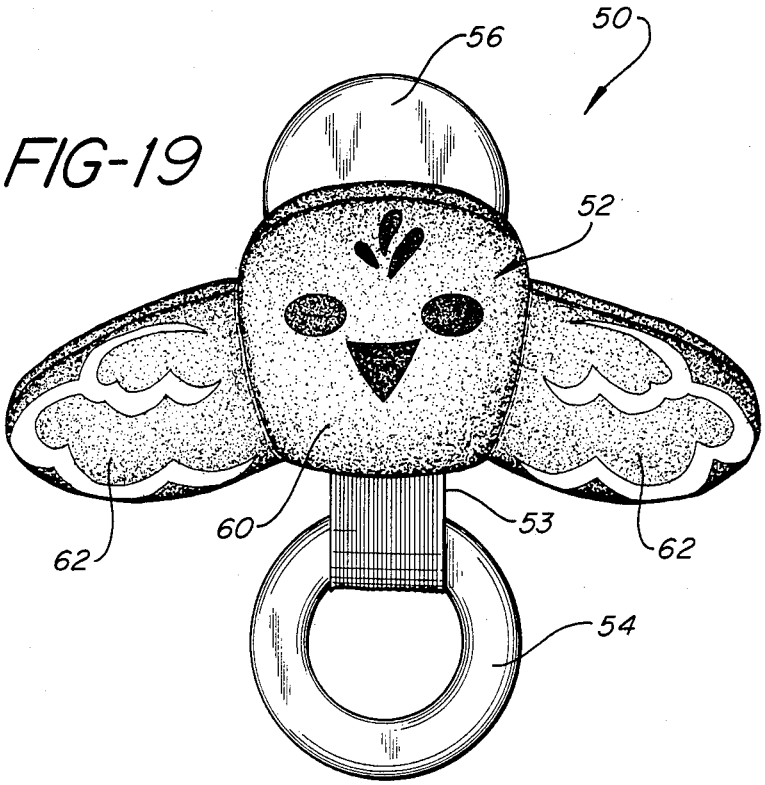
Figure 20:
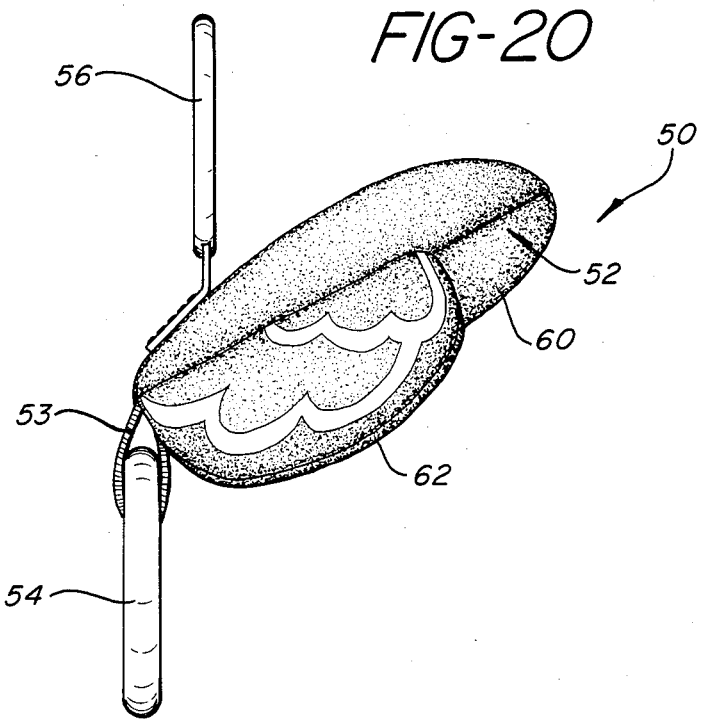
FIG. 20 is a left side view of the thing to arouse attention shown in FIG. 16.
Figure 21:
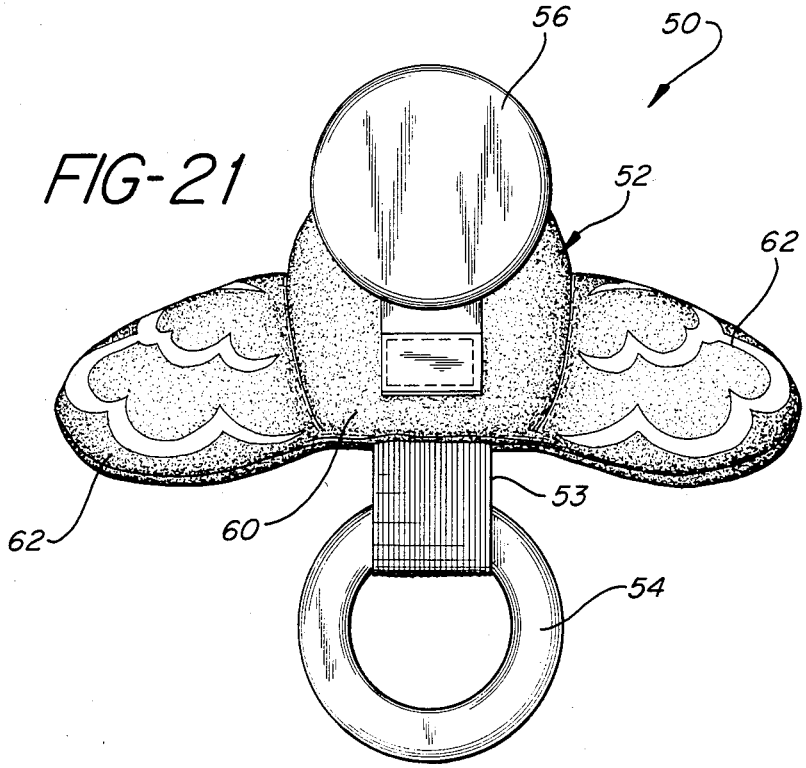
FIG. 21 is a rear elevation of the thing to arouse attention shown in FIG. 16.

As can be seen in FIG. 1 and FIG. 8, three belt-like members 22 are fixed to the inside face at about the center of the arched support. Each of the second belt-like members 22 has its central portion connected to arched support 12 to leave two free ends. A piece **22*a* constituting one portion of the Velcro fastener is disposed on the two free ends of the second belt-like members 22. A piece 24*a* constituting the other portion of the Velcro fastener is disposed on both sides of the third belt-like members 24 near one end. The third belt-like members 24 can be constructed by disposing one piece and the other piece of the Velcro fasteners in the belt-like members 24 so that belt-like member 24 can be maintained in a folded condition. The other end of each of the third belt-like members 24 has a connecting device 26, for connection to things 30, 50 to arouse attention. Preferably, connecting device 26 comprises a disc-like housing member which can be connected to a disc-like connecting member on the things 30, 50** to arouse attention.

Next, an example of things to arouse attention will be explained by referring to FIGS. 9 to 15.

Thing 30 to arouse attention comprises a backing body 32, a rotator 34 rotatably mounted on the backing body 32, a plurality of sheet-like bodies 36, 38 fixed to the rotator 34 by means of rotator extensions **34*a***, respective faces of the sheet-like bodies having different designs or colors.

The backing body 32 comprises the disc-like connecting member 40. As above, this disc-like connecting member 40 is snapped into the connecting device 26 of the third belt-like member 24. By virtue of this, the backing body 32 is connected to the above arched support 12 for baby's toy.

The backing body 32 comprises a rigid hollow enclosure with a rigid sphere movably disposed therein which, when thing 30 is moved, produces a sound.

Sheet-like bodies 36, 38 comprise a plastic sheet 39 and a cloth covering 37 which encloses the elastic sheet.

Since this thing 30 to arouse attention rotates as the baby touches sheet-like bodies 36, 38 and each face of the sheet-like bodies 36, 38 has different designs or colors, the baby is encouraged to touch and handle the thing 30 to arouse attention.

Next, the second example of the things to arouse attention will be explained by referring to FIGS. 16–21.

This thing 50 to arouse attention comprises a body 52, a ring 54 attached to the body 52 by means of an elastic belt 53, a connecting means 56 for connection to the connecting device 26 of a third belt-like member 24 and a sound-producing means which produces sound by vibrations.

The elastic body 52 is constructed with an elastic material and has a cloth covering. The elastic body 52 has a shape with a bird as the motif comprising body portion 60 and two wing portions 62 attached to th portion 60.

A sound-producing means is arranged on the wing portion of the elastic body 52. A sound is produced by vibrating the wing portion 62.

What is claimed is:

1. A baby's toy to be attached to, and used in, a crib comprising:

(a) a flexible arched support;

(b) means disposed near each end of the arched support for securing the arched support to a crib;
(c) things to arouse attention; and
(d) means for connecting the things to arouse attention to the arched support, the arched support comprising at least two parallel, generally elongated body elements formed from foamed plastic panels which are flexible and substantially noncompressible under load, said elongated body elements being enclosed in converings.

2. A baby's toy according to claim 1 wherein the elongated body elements have a generally rectangular cross-section and the covering is cloth.

3. A baby's toy according to claim 1 wherein the arched support has a generally rectangular cross-section which is relatively thin and relatively wide.

4. A baby's toy according to any one of claims 1 to 3 wherein each of said securing means comprises a pair of first belt-like members which are fixed at their cnetral portions to said arched support to leave a pair of free ends for each first belt-like member, one free end of each of said belt-like members having a first piece of Velcro fastener on one side thereof and the other of said free ends of each of said first belt-like members having a second mating piece of Velcro fastener on the other side thereof.

5. A baby's toy according to claim 4 wherein the two first belt-like members near each end of the arched support are disposed side by side.

6. A baby's toy according to any one of claims 1 to 3 wherein at least one of said means for connecting the things to arouse attention to the arched support includes a relatively short belt-like element fixed to the arched support and a relatively long belt-like member having a first end and a second end, said relatively short belt-like member having one piece of Velcro fastener and said relatively long belt-like member having another, mating piece of Velcro fastener on one surface thereof near its said first end.

7. A baby's toy according to claim 6 wherein the relatively short belt-like member is fixed to the inside face at about the center of the arched support.

8. A baby's toy according to claim 6 wherein the relatively short belt-like member is connected at its central portion to the arched support to leave two free ends, a piece constituting one portion of a Velcro fastener being disposed on the two free ends of the relatively short belt-like member and a piece constituting the other portion of a Velcro fastener being disposed on both sides of the relatively long belt-like member.

9. A baby's toy according to claim 6 wherein a thing to arouse attention is detachably connected to the relatively long belt-like member.

10. A baby's toy according to claim 7 wherein there are a plurality of relatively short belt-like members fixed to the inside face of the arched support.

11. A baby's toy according to claim 9 wherein the second end of said relatively long belt-like member includes a disc-like housing member and said thing to arouse attention includes a disc-like connection member adapted to be engaged with said disc-like housing member, whereby said thing to arouse attention is detachably connectable to said relatively long belt-like member.

12. A baby's toy according to claim 1 wherein the things to arouse attention have different shapes and are respectively provided with sound-producing means, the tones due to the sound-producing means being different from each other.

13. A baby's toy according to any one of claims 1–3 wherein each elongated body element is covered with a covering and the covered elongated bodies are connected to each other between said two elongated body elements so as to leave a longitudinal spacing therebetween.

14. A baby's toy according to any one of claims 1–3 wherein said foamed plastic is a polyethylene foam having a specific gravity of about 0.03 to about 0.15.

15. A baby's toy to be attached to, and used in, a crib comprising:
(a) a flexible arched support;
(b) means disposed near each end of the arched support for securing the arched support to a crib;
(c) things to arouse attention; and
(d) means for connecting the things to arouse attention to the arched support, the arched support comprising an elongated body element formed from a foamed plastic panel which is flexible and substantially noncompressible under load, said elongated body element being enclosed in a covering.

* * * * *

UNITED STATES PATENT AND TRADEMARK OFFICE

CERTIFICATE OF CORRECTION

PATENT NO. : 4,722,713

DATED : February 2, 1988

INVENTOR(S) : D. Michael Williams and Lois E. Kelly

It is certified that error appears in the above-identified patent and that said Letters Patent is hereby corrected as shown below:

Column 5, line 10, "converings" should be --coverings--.

Column 5, line 19, "cnetral" should be --central--.

Signed and Sealed this

Twelfth Day of July, 1988

*Attest:*

*Attesting Officer*

DONALD J. QUIGG

*Commissioner of Patents and Trademarks*